United States Patent [19]

Graves et al.

[11] 4,111,411

[45] Sep. 5, 1978

[54] SHEET STACKING APPARATUS

[75] Inventors: Bernard Albert Graves; John Edward Mockett, both of Deptford, England

[73] Assignee: Masson Scott Thrissell Engineering Ltd., London, England

[21] Appl. No.: 808,945

[22] Filed: Jun. 21, 1977

[30] Foreign Application Priority Data

Jun. 29, 1976 [GB] United Kingdom ..... 27101/76

[51] Int. Cl.[2] ..... B65H 29/14; B65H 29/60; B65H 29/68; B65H 31/32

[52] U.S. Cl. ..... 271/199; 198/425; 198/577; 214/6 P; 271/64; 271/202; 271/218

[58] Field of Search ..... 271/199, 202, 203, 182, 271/183, 64, 218, 217; 198/425, 577, 422; 214/6 P

[56] References Cited

U.S. PATENT DOCUMENTS

| | | | |
|---|---|---|---|
| 1,942,172 | 1/1934 | Johnson | 271/217 |
| 2,521,075 | 9/1950 | Matthews | 271/218 |
| 3,363,739 | 1/1968 | Mebus | 198/425 |
| 4,040,618 | 8/1977 | Vermes et al. | 271/202 |

*Primary Examiner*—Bruce H. Stoner, Jr.
*Attorney, Agent, or Firm*—Seidel, Gonda & Goldhammer

[57] ABSTRACT

A stack of sheets is formed in a paper cutter by feeding spaced sheets from a first conveyor to a second and slower conveyor to overlap the sheets which are then fed onto a pallet, the latter being lowered as more sheets are fed. When a stack is near completion the first and second conveyors are decelerated and some sheets diverted from the first conveyor to form a gap in the flow of sheets, the second conveyor only is then accelerated for a period of time to enlarge the gap and then decelerate, both conveyors then being accelerated to normal speed. An auxiliary support is then moved into the path of the sheets falling on to the pallet in the gap previously created. While the completed stack is being removed a new stack is forming on the auxiliary support. The full pallet is replaced by an empty one and the auxiliary support is withdrawn to permit the new stack to drop onto the pallet. The gap may be created without diverting any sheets from the first conveyor and the stack may be changed without the use of the auxiliary support.

5 Claims, 1 Drawing Figure

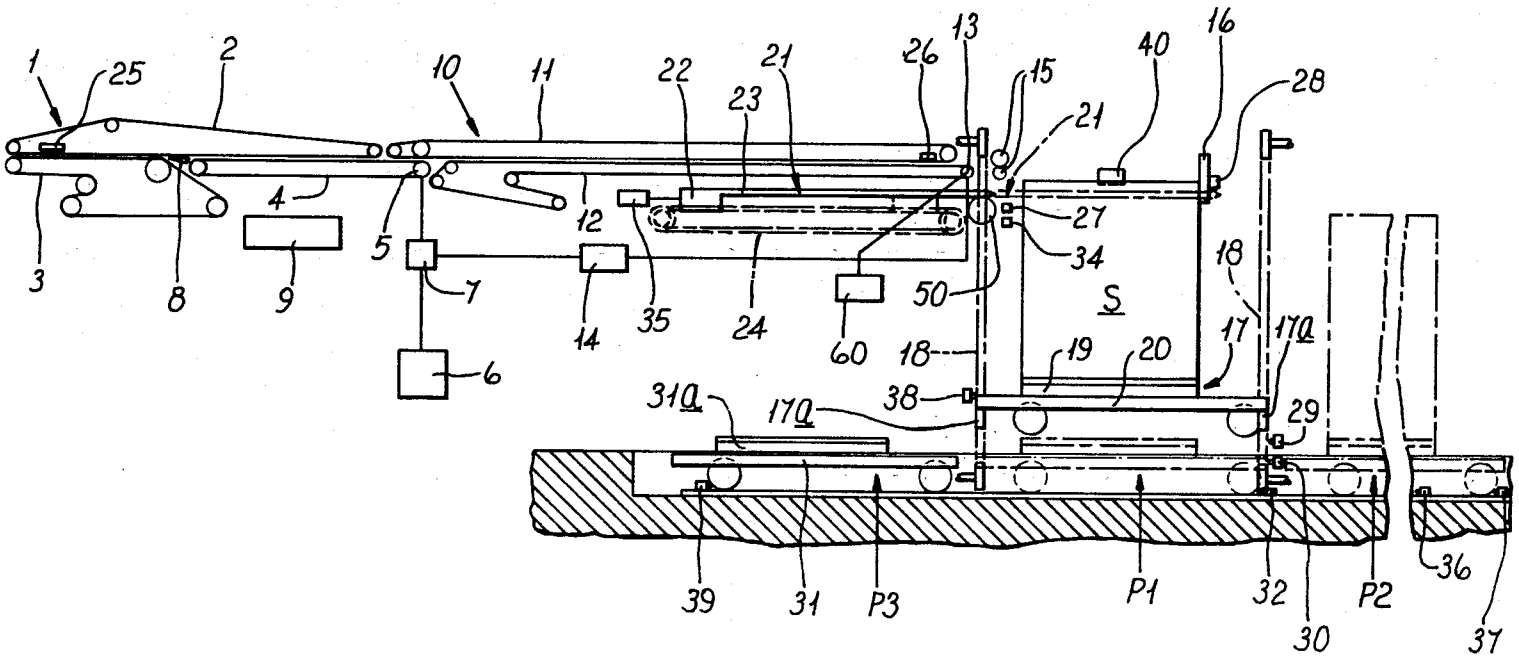
1
2
3
4
5
6
7
8
9
10
11
12
13
14
15
16
17
17a
18
19
20
21
22
23
24
25
26
27
28
29
30
31
31a
32
34
35
36
37
38
39
40
50
60
S
P1
P2
P3

SHEET STACKING APPARATUS

This invention concerns improvements in or relating to sheet stacking apparatus for use, for example, in receiving sheets of paper from a cutter.

Such a stacking apparatus (otherwise termed "layboy") is required to receive sheets in succession at high speed and to assemble the sheets into a regular stack without damage. To enable this to be accomplished it is normal for the sheets to be decelerated and overlapped ("shingled") prior to stacking.

Provision has to be made for removal of the stack of sheets when it contains a desired number of sheets, but it must be possible for such removal to be effected without undue interruption in the feed of sheets towards the stacking apparatus as such interruptions affect the economies of sheet production. Where relatively small stacks are to be formed and because stack removal occurs at short intervals, it is known to provide two or more stacking devices which are used in sequence so that when a stack of suitable size has been completed in one device, that stack may be removed, while the flow of sheets is directed to another of the stacking devices.

In such stacking devices, the sheets are commonly fed along a substantially horizontal path to the vicinity of the stack being formed and are projected by feed rollers or belts into a space above the growing stack so that they travel freely across said space to strike a stop member (termed a "backboard") and fall on to the stack. The speed of projection of the sheets and the distance they have to fall on to the stack are both significant factors in obtaining good stack formation. To avoid variation of said distance, the stack being formed is usually carried on a vertically movable platform at a rate corresponding to the rate of increase of stack height.

It is usual to provide means for counting the number of sheets being fed, such means being placed before the position at which the sheets are overlapped. When the required number of sheets to form a stack have been counted, a diverter is operated to divert a few sheets away from the normal feed path so as to form a gap in the flow of sheets. This permits an auxiliary support to be moved temporarily into an operative position above the platform to receive the sheets while a stack of sheets already formed on the latter is removed. However, the correct operation of such an auxiliary support is difficult to achieve in the time available, which is dependent upon the size of the gap created in the flow of sheets (and hence the number of sheets diverted) and the speed at which the latter are being fed.

According to the present invention there is provided sheet stacking apparatus comprising a stop member, a first conveyor arranged to carry a succession of sheets spaced apart in their direction of travel, a second conveyor arranged to receive said sheets from said first conveyor and carry them to a delivery position horizontally spaced from said stop member by more than a sheet length and with sufficient velocity to travel into engagement with said stop member, means for driving said first and second conveyors so that said second conveyor travels at a slower speed than that of said first conveyor, and said sheets on transfer to said second conveyor are brought into overlapping relationship, a movable platform below the space between said second conveyor and said stop member and on to which sheets are fed in succession to form a stack containing a selected number of sheets, hoisting means for raising and lowering said platform, and further drive means adapted to be connected to and disconnecting from said second conveyor, wherein said drive means is operated to decelerate said first and second conveyors in unison, said further drive means is arranged to be connected for a predetermined period of time to said second conveyor after such deceleration to cause the latter to accelerate relative to said first conveyor, and to be disconnected from said second conveyor after said predetermined period of time has elapsed, to cause said second conveyor to decelerate relative to said first conveyor.

The apparatus according to the invention may further comprise means for diverting sheets from said first conveyor and control means for initiating operation of said diverting means when said selected number of sheets has reached said second conveyor, wherein said control means is so arranged that said diverting means is operated to divert sheets from said first conveyor when said second conveyor has been accelerated to a predetermined speed by said further drive means, and so that said diverting means ceases to operate after a predetermined number of sheets has been diverted from said first conveyor.

Preferably said apparatus further comprises an auxiliary support movable horizontally between an operative position, in the path of and above said platform, and an inoperative position completely clear of said path, means for moving said auxiliary support between said operative and inoperative positions, detector means in the vicinity of said delivery position for sensing the passage of the last sheet of said selected number, means under control of said detector means for initiating operation of said hoisting means to lower said platform, and means for initiating operation of said moving means to move said auxiliary support to said operative position as soon as said hoisting means has lowered said platform to a position such that the top of the stack formed on said platform is below the level of said auxiliary support.

A preferred embodiment of the invention will now be described, by way of example only, with reference to the accompanying drawing which is a diagrammatic view, in elevation, of a sheet stacking apparatus.

A succession of sheets of paper or board, spaced apart in their direction of travel, are fed to a first conveyor 1 which comprises upper belts 2 and lower belts 3, 4, the sheets being carried in conventional manner between the upper and lower belts. The belts are supported on rollers as shown, and the belt 4 is driven, via a roller 5 and a gear box 7, by a motor 6, the belts 2, 3 being driven from roller 5 in known manner. Positioned in the gap between adjacent ends of the belts 3, 4 is a diverter 8 of any known type which is operated at certain times, as will be explained later, to divert sheets away from the conveyor 1 into a waste box 9.

From the conveyor 1 the sheets are fed onto a second conveyor 10 which comprises upper belts 11 and lower belts 12, the latter terminating, at the right-hand end thereof, at a roller 13 which is driven from the motor 6 through the gear box 7 and a variable ratio gear box 14. The arrangement is such that the conveyor 10 is driven at a slower speed than that of conveyor 1 so that the sheets are brought into overlapping relationship (shingled) in known manner as they are fed onto conveyor 10. The variable ratio gear box 14 enables the speed of the conveyor 10 to be changed, relative to that of the conveyor 1, so that the amount by which the sheets are overlapped may be controlled.

A further motor 60 is also provided which may be selectively connected to and disconnected from the roller 13, by means of a clutch (not shown). At certain times (e.g. when a completed stack is removed from the machine and a new one started) the drive to roller 13, and hence conveyor 10, from motor 6, is disconnected by means of a further clutch (not shown), and the conveyor driven by the motor 60 so that it is running at a higher speed than the conveyor 1.

From conveyor 10 the sheets are fed between a pair of cooperating rollers 15 and on leaving the nip of these rollers each sheet travels to the right above a stack S, in the course of formation, until it strikes a backboard 16, whereupon the sheet falls on top of the stack. The stack is formed on a platform 17, which is carried on lugs 17*a* attached to chains 18 which are used to raise and lower the platform 17 in the usual way. The platform 17 comprises a pallet 19 supported on a trolley 20. During stack formation the platform 17 is lowered a short distance at a time, under the control of a stack height sensor 40 (which may be of the photo-electric or capacitative type) so that the top of the stack S is maintained at optimum spacing below the path of the sheets from rollers 15 to the backboard 16.

So that the stack S may be removed from the machine when it is completed and a new stack formed, without having to stop the machine, an auxiliary support in the form of a horizontally slidable grill 21 is provided at a level a little below that at which the top of the growing stack of sheets is normally maintained. The grill 21 consists of a beam 22 in which is supported one end of each of a number of long bars 23 which are spaced apart across the width of the machine, and which is moved between an inoperative position (shown in full lines in the drawing) and an operative position (shown in chain-dot line) by means of chains 24 (only one of which is visible in the drawing) attached to each end of the beam 22. Each bar 23 is also supported by a separate wheel 50 mounted on a fixed part (not shown) of the apparatus.

The sequence of operations for removing a completed stack and starting the formation of a new one will now be described.

As the sheets are being fed by the belts 2, 3 they are counted by a counter 25, of any known form, and when the count reaches a predetermined number less than the number of sheets required to complete the stack, the conveyors 1, 10 and the rollers 15 are decelerated until they reach a minimum speed such that proper feeding and stacking of the sheets is maintained. When the count reaches the required number of sheets, the counter 25 triggers a delay device (not shown) and when the last sheet to be counted reaches the conveyor 10 the diverter 8 is operated to divert the succeeding few sheets into the waste box 9. At the same time the conveyor 10 is accelerated, relative to the conveyor 1, by disconnecting the drive from motor 6 and connecting the drive from motor 60. When a predetermined number of sheets have been diverted into the box 9, the diverter 8 is operated so that the sheets are again fed onto conveyor 10 which, at the same time is decelerated, relative to conveyor 1, until it reaches its former speed again. The diverting of some sheets to the box 9 creates a gap in the flow of sheets on the conveyor 10, which gap is made larger, without having to divert more sheets, by the sheets on conveyor 10 being fed faster, relative to those on conveyor 1, during the time when sheets are being diverted.

Sheets continue to be fed onto the top of the stack S, as described above, and when the trailing edge of the last sheet to be fed onto stack S passes a photo-electric detector 26 the latter causes the chains 18 to be driven so that the platform 17 starts to move downwards continuously. When the top of the now completed stack of sheets passes a photo-electric detector 27 the chains 24 are driven so that the grill 21 is moved to the right from the full line position to the chain-dot position. When the grill 21 has reached the extent of its movement to the right, which is detected by a limit switch 28, the conveyors 1, 10 and rollers 15 are accelerated to the normal running speed of the machine, and the next stack of sheets starts to accumulate on top of the grill 21.

The platform continues downwards until it operates a switch 29 which causes the rate of descent to decrease and the trolley 20 comes to rest on the floor in position P1. The arrival of the trolley at this position is detected by a switch 30. The chains 18 continue their movement until the lugs 17*a* disengage from the trolley 20, when they are stopped.

The trolley 20 is now moved to the right to an unloading position P2. As the trolley 20 is moved to this position, a further trolley 31, carrying an unloaded pallet 31*a*, is moved from a waiting position P3 to the position P1, below the grill 21, where its presence is detected by a switch 32, and which causes the drive to the chains 18 to be energised so that the lugs 17*a* engage in the trolley 31 and start to raise it. The trolley 31 is raised until the top of the pallet 31*a* is a short distance below the level of the grill 21, at which time the trolley operates a switch 34 and the raising of the trolley is stopped. Sheets continue to be delivered during the lowering of the trolley 20 and the raising of trolley 31, so that by the time the trolley 31 is stopped just below grill 21, a small stack of sheets has accumulated on the grill, and when the top of this small stack reaches the normal level of the stack top, the drive to the chains 24 is energised to move the grill 21 to its inoperative (full line) position, the small stack falling onto the pallet 31*a* carried on the trolley 31. As sheets continue to be delivered to the top of the stack, the trolley 31 descends slowly, as required, to maintain the top of the stack at the correct level. The presence of the grill in the inoperative position is detected by a limit switch 35.

Just prior to arriving at the unloading position P2, the trolley 20 operates a switch 36 which causes the trolley to slow down and it is brought to rest at position P2 when it operates a limit switch 37. The pallet 19 and stack of sheets are removed from, and a new pallet put onto, the trolley 20, which is then moved to the waiting position P3. Alternatively the new pallet may be put onto the trolley whilst it is at position P3. However, this movement is inhibited until the trolley 31 operates a switch 38 whilst it is being raised as described above, the switch being positioned so that there is sufficient room for the trolley 20 to pass beneath the trolley 30. Arrival of the trolley at position P3 is detected by a switch 39.

Whilst a trolley is being lowered during formation of a stack it operates the switch 38 and, if the empty trolley is still at position P2 normal machine operations are inhibited in a predetermined way (e.g. the diverter 8 may be operated so that all the sheets being fed to conveyor 1 are diverted into the box 9). If the empty trolley is at position P3 the operation of the machine is not affected.

The sequence of operations set out above is accomplished automatically, and the various switches and detectors mentioned are provided to ensure that each of the several steps of operation should not be initiated unless and until the correct condition is reached.

Although, as described above, the gap in the flow of sheets is created by firstly diverting some sheets to the box 9 and then accelerating the speed of conveyor 10 relative to that of conveyor 1, it should be noted that the required gap could be created without the need to divert any sheets to the box 9. This may be accomplished by suitably choosing the respective speeds of the conveyors 1 and 10, during the time in which they are being decelerated and accelerated.

The auxiliary support 21 may also be omitted if desired by making the gap created in the flow of sheets large enough so as to give enough time, i.e. whilst no sheets are being fed onto a stack by the rollers 15, to remove a completed stack and start the formation of a new one on the platform 17. In this instance especially, the respective speeds of the conveyors 1,10 may need to be such that the conveyor 1 is stopped prior to the speed of the conveyor 10 being accelerated on the latter being connected to the motor 60.

In the instance where the auxiliary support 21 is omitted the starting of a new stack is different from that described above in that, after a completed stack has been removed from the machine a new trolley, carrying an unloaded pallet, is raised from position P1 until the top of the pallet reaches a position such that the sheets for forming the next stack are fed directly on to the pallet instead of onto the bars 23 as previously described.

It should of course be noted that the operation of the machine in forming the rest of the stack on the platform 17 and the removal of a completed stack is the same as described above, regardless of whether or not the diverter 8 and/or the auxiliary support 21 are used.

We claim:

1. Sheet stacking apparatus comprising a stop member, a first conveyor arranged to carry a succession of sheets spaced apart in their direction of travel, a second conveyor arranged to receive sheets from said first conveyor and carry them to a delivery position horizontally spaced from said stop member by more than a sheet length and with sufficient velocity to travel into engagement with said stop member, means for driving said first and second conveyors so that said second conveyor travels at a slower speed than that of said first conveyor, and said sheets on transfer to said second conveyor are brought into overlapping relationship, a movable platform below the space between said second conveyor and said stop member and on to which sheets are fed in succession to form a stack containing a selected number of sheets, hoisting means for raising and lowering said platform, and further drive means adapted to be connected to and disconnected from said second conveyor, wherein said drive means is operable to decelerate said first and second conveyors in unison, said further drive means is arranged to be connected for a predetermined period of time to said second conveyor after such deceleration to cause the latter to accelerate relative to said first conveyor, and to be disconnected from said second conveyor, after said predetermined period of time has elapsed, to cause said second conveyor to decelerate relative to said first conveyor.

2. Apparatus as claimed in claim 1 further comprising means for diverting sheets from said first conveyor and control means for initiating operation of said diverting means when said selected number of sheets has reached said second conveyor, wherein said control means is so arranged that said diverting means is operated to divert sheets from said first conveyor when said second conveyor has been accelerated to a predetermined speed by said further drive means and so that said diverting means ceases to operate after a predetermined number of sheets has been diverted from said first conveyor.

3. Apparatus as claimed in claim 1 further comprising an auxiliary support movable horizontally between an operative position, in the path of and above said platform, and an inoperative position completely clear of said path, means for moving said auxiliary support between said operative and inoperative positions, detector means in the vicinity of said delivery position for sensing the passage of the last sheet of said selected number, means under control of said detector means for initiating operation of said hoisting means to lower said platform, and means for initiating operation of said moving means to move said auxiliary support to its operative position as soon as said hoisting means has lowered said platform to a position such that the top of the stack formed on said platform is below the level of said auxiliary support.

4. Apparatus as claimed in claim 1 further comprising an auxiliary support movable horizontally between an operative position, in the path of and above said platform, and an inoperative position completely clear of said path, means for moving said auxiliary support between said operative and inoperative positions, detector means in the vicinity of said delivery position for sensing the passage of the last sheet of said selected number, means under control of said detector means for initiating operation of said hoisting means to lower said platform, means for initiating operation of said moving means to move said auxiliary support to its operative position as soon as said hoisting means has lowered said platform to a position such that the top of the stack formed on said platform is below the level of said auxiliary support, means for diverting sheets from said first conveyor and control means for initiating operation of said diverting means when said selected number of sheets has reached said second conveyor, wherein said control means is so arranged that said diverting means is operated to divert sheets from said first conveyor when said second conveyor has been accelerated to a predetermined speed by said further drive means, and so that said diverting means ceases to operate after a predetermined number of sheets has been diverted from said first conveyor.

5. Apparatus as claimed in claim 1 in which said platform includes a trolley and said hoisting means includes a plurality of chains and an equal number of lugs arranged so that each of said chains has one of said lugs fixed thereto, said lugs being engageable with and disengageable from said trolley, wherein said hoisting means is operated to engage said lugs with said trolley to raise the latter to a position at which sheets are fed to commence the formation of a stack thereon, to lower said trolley while said selected number of sheets is so fed, and thereafter to lower said trolley to a position such that said lugs are disengageable from said trolley to permit the latter to be moved away from the machine.

* * * * *